US010994981B2

(12) United States Patent
Reichelt et al.

(10) Patent No.: US 10,994,981 B2
(45) Date of Patent: May 4, 2021

(54) STATIC AND DYNAMIC DISPLAY DISPENSER FOR IN-LINE FLUID FLOW WITH NOVEL ACCESSORIES, APPARATUS, SYSTEM, AND A METHOD THEREOF

(71) Applicants: Ovid Forest Reichelt, Poughkeepsie, NY (US); Denis S. Barry, Poughkeepsie, NY (US)

(72) Inventors: Ovid Forest Reichelt, Poughkeepsie, NY (US); Denis S. Barry, Poughkeepsie, NY (US)

(73) Assignee: TAP DISPENSARY TECHNOLOGY, LLC, Copake Falls, NY (US)

( * ) Notice: Subject to any disclaimer, the term of this patent is extended or adjusted under 35 U.S.C. 154(b) by 0 days.

(21) Appl. No.: 16/702,439

(22) Filed: Dec. 3, 2019

(65) Prior Publication Data

US 2020/0156919 A1 May 21, 2020

Related U.S. Application Data

(63) Continuation-in-part of application No. 15/234,656, filed on Aug. 11, 2016, now abandoned.

(60) Provisional application No. 62/205,525, filed on Aug. 14, 2015.

(51) Int. Cl.

| | |
|---|---|
| ***B67D 1/00*** | (2006.01) |
| ***B67D 1/08*** | (2006.01) |
| ***B67D 1/14*** | (2006.01) |

(52) U.S. Cl.

CPC ..... *B67D 1/0877* (2013.01); *B67D 1/0888* (2013.01); *B67D 1/1477* (2013.01)

(58) Field of Classification Search

CPC .. B67D 1/0855; B67D 1/0877; B67D 1/1477; B67D 1/0874; B67D 1/0888; B67D 1/1211; B67D 1/0872; A45C 2011/001; A45C 2011/002; A45C 2011/003; G01F 13/006; G01F 13/008

USPC ..... 222/23, 25, 230, 640, 641, 146.6

See application file for complete search history.

(56) References Cited

U.S. PATENT DOCUMENTS

| | | | | |
|---|---|---|---|---|
| 2,631,393 A * | 3/1953 | Hetherington | B67D 1/0872 | 40/332 |
| 4,350,267 A * | 9/1982 | Nelson | B67D 1/04 | 222/131 |
| 5,412,547 A | 5/1995 | Hornblad | | |
| 5,908,142 A * | 6/1999 | Sacchetti | B67D 1/0875 | 222/192 |

(Continued)

*Primary Examiner* — Charles P. Cheyney

(74) *Attorney, Agent, or Firm* — Aziz M. Ahsan; Ahsan & Associates PLLC

(57) ABSTRACT

The present invention relates generally to a static and dynamic display dispenser for in-line fluid flow, apparatus, system, and a method of using same. More particularly, the invention encompasses an inventive fluid measuring apparatus having a tap shell housing or handle, a tap head or frame, at least one display screen, a tap stem, and a tap adaptor to connect the tap shell housing or handle to a tap spigot system. The inventive fluid measuring apparatus has at least one means to measure in real-time the fluid or liquid that is being dispensed. The inventive fluid measuring apparatus has at least one means to transmit the collected data to at least one other electronic device via a wired or wireless connection. The invention also allows for the display of at least one image. The invention also provides a method of using the inventive fluid measuring apparatus.

18 Claims, 6 Drawing Sheets

(56) References Cited

U.S. PATENT DOCUMENTS

| | | | | |
|---|---|---|---|---|
| 6,230,769 | B1 * | 5/2001 | O'Brien | B67D 1/06 137/378 |
| 6,471,056 | B1 * | 10/2002 | Tzeng | A45C 11/00 150/154 |
| 6,659,274 | B2 * | 12/2003 | Enners | G06F 1/1626 206/305 |
| 6,926,141 | B2 * | 8/2005 | Montler | H01H 9/0242 206/320 |
| D701,433 | S * | 3/2014 | Ahlstrom | D7/608 |
| 9,144,279 | B2 * | 9/2015 | Venida | A45C 11/34 |
| D773,244 | S * | 12/2016 | Koski | D7/398 |
| 2008/0197146 | A1 | 8/2008 | Eyler | |
| 2011/0240187 | A1 | 10/2011 | Gaynor | |
| 2014/0049142 | A1 * | 2/2014 | Magness | G06F 1/1656 312/223.1 |
| 2015/0329346 | A1 * | 11/2015 | Miller | B67D 1/0874 222/48 |
| 2019/0074859 | A1 * | 3/2019 | Kim | H04M 1/0266 |

* cited by examiner

STATIC AND DYNAMIC DISPLAY DISPENSER FOR IN-LINE FLUID FLOW WITH NOVEL ACCESSORIES, APPARATUS, SYSTEM, AND A METHOD THEREOF

CROSS-REFERENCE TO RELATED APPLICATIONS

The instant Patent Application is a Continuation-In-Part of U.S. Non-Provisional patent application Ser. No. 15/234,656, filed on Aug. 11, 2016, titled "Static And Dynamic Display Dispenser For In-Line Fluid Flow, Apparatus, System, And A Method Thereof," which patent application claimed priority to and the benefit of U.S. Provisional Patent Application Ser. No. 62/205,525, filed on Aug. 14, 2015, titled "Static And Dynamic Display Dispenser For In-Line Fluid Flow, Apparatus, System, And A Method Thereof," the entire disclosure of each patent application is incorporated herein by reference.

FIELD OF THE INVENTION

The present invention relates generally to a static and dynamic display dispenser for in-line fluid flow, apparatus, system, and a method of using same. More particularly, the invention encompasses an inventive fluid measuring apparatus having a tap shell housing or handle, a tap head or frame, at least one display screen, a tap stem, and a tap adaptor to connect the tap shell housing or handle to a tap spigot system. The inventive fluid measuring apparatus has at least one means to measure in real-time the fluid or liquid that is being dispensed. The inventive fluid measuring apparatus has at least one means to transmit the collected data to at least one other electronic device via a wired or wireless connection. The invention also allows for the display of at least one image. The invention also provides a method of using the inventive fluid measuring apparatus.

PURPOSES AND SUMMARY OF THE INVENTION

The invention is a novel fluid measuring apparatus and a method of using same.

Therefore, one purpose of this invention is to provide a fluid measuring apparatus having a tap shell housing or handle, a tap head or frame, a display screen, a tap stem, and a tap adaptor to connect the tap shell housing to a tap spigot system.

Another purpose of this invention is to provide a decorative or stylistic or themed or fancy display or screen to a fluid measuring apparatus.

Yet another purpose of this invention is to provide a decorative or stylistic or themed or fancy tap head or frame to a fluid measuring apparatus.

Still yet another purpose of this invention is to provide at least one location for the display of at least one decorative element.

Therefore, in one aspect this invention comprises an in-line fluid flow measuring apparatus, comprising, (a) a tap shell housing having a tap stem at one end, and a tap head at an opposite end;
(b) said tap head having at least one digital display screen;
(c) said tap stem having a tap adaptor, wherein said tap adaptor securely engages with a tap spigot system; and
(d) said spigot system having at least one line connection with at least one fluid dispenser at one end, and at least one opening at an opposite end for dispensing of said at least one fluid.

In another aspect this invention comprises an in-line fluid flow measuring and dispensing apparatus, comprising:

(a) a tap shell housing having a tap stem at one end, and a tap head at an opposite end, and wherein said tap shell housing has at least one electronic switch;
(b) said tap head having at least one first digital display screen on one side of said tap head, and at least one second digital display screen on the opposite side of said tap head;
(c) said tap stem having a tap adaptor, wherein said tap adaptor securely engages with a tap spigot system;
(d) said spigot system having at least one line connection with at least one fluid dispenser at one end, and at least one opening at an opposite end for dispensing of said at least one fluid; and
(e) wherein a tap head protective sleeve having at least one fluid proof window is slideably slid over said tap head, and wherein said tap head protective sleeve protects one of said at least one first digital display screen, and said at least one second digital display screen, and said at least one fluid proof window allows an unobstructed viewing of one of said at least one first digital display screen, and said at least one second digital display screen.

In yet another aspect this invention comprises an in-line fluid flow measuring and dispensing apparatus, comprising:

(a) a tap shell housing having a tap stem at one end, and a tap head at an opposite end, and wherein said tap shell housing has at least one electronic switch;
(b) said tap head having at least one first digital display screen on one side of said tap head, and at least one second digital display screen on the opposite side of said tap head;
(c) said tap stem having a tap adaptor, wherein said tap adaptor securely engages with a tap spigot system;
(d) said spigot system having at least one line connection with at least one fluid dispenser at one end, and at least one opening at an opposite end for dispensing of said at least one fluid; and
(e) wherein said tap shell housing is a telescopic housing, such that said tap head moves from a first place to a second place telescopically.

BRIEF DESCRIPTION OF THE DRAWINGS

The invention may best be further understood by reference to the ensuing detailed description in conjunction with the drawings in which.

DETAILED DESCRIPTION

Figure 1:
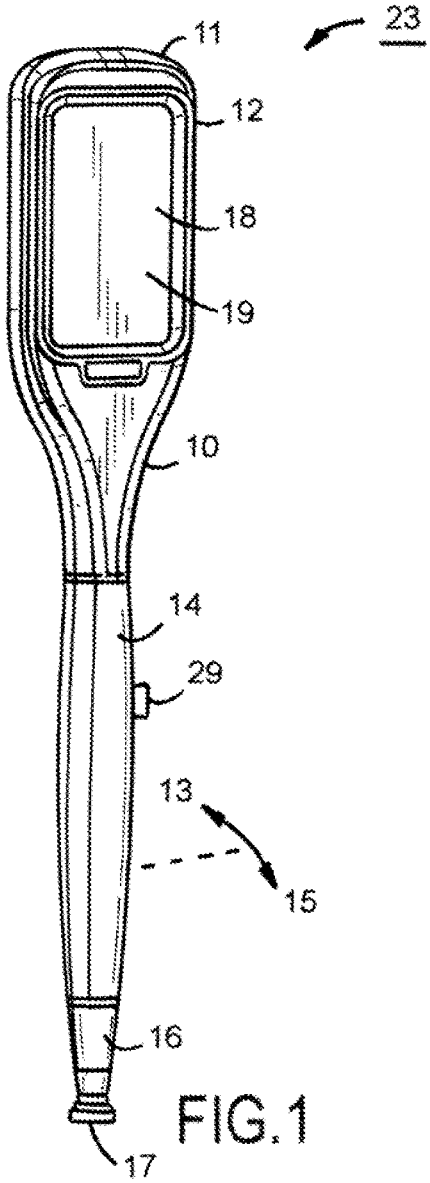
FIG. 1, illustrates a perspective view of an inventive fluid measuring apparatus, according to one embodiment of this invention.

The inventive fluid measuring apparatus, system, and a method of using same will now be discussed with reference to FIGS. 1 through 19. Although the scope of the present invention is much broader than any particular embodiment, a detailed description of the preferred embodiment follows together with drawings. These drawings are for illustration purposes only and are not drawn to scale. Like numbers represent like features and components in the drawings.

FIG. 1, illustrates a perspective view of an inventive fluid measuring apparatus 23, according to one embodiment of this invention. The inventive fluid measuring apparatus 23, further comprises of a tap shell housing or handle 10, a cover 11, a tap head or frame 12, a tap stem 14, and a tap adaptor 16. The tap adaptor 16, could have a male or female connection 17. The tap head or frame 12, preferably has at least one display or screen 18. For some applications the display or screen 18, could be a touch sensitive display or screen 18. Additionally, for some applications the display or screen 18, could have at least one layer of a water or liquid resistant or repellent layer or material or cover 19, in order to protect the display or screen 18, from liquid or water damage, and also in helping to prevent cracks in the display screen 18. It should be appreciated that the tap shell housing 10, of the inventive fluid measuring apparatus 23, can be moved from a first position 13, to a second position 15. The movement of the tap shell housing 10, from the first position 13, to a second position 15, could be selected from a group comprising a vertical position, a horizontal position, a rotational position, a translational position, a sliding position, and combinations thereof, to name a few. For some applications one could optionally have a switch 29, such as, for example, an ON/OFF switch 29, an activation switch 29, a reset switch 29, to name a few, on the handle 10, or the tap shell housing 10.

Figure 2:
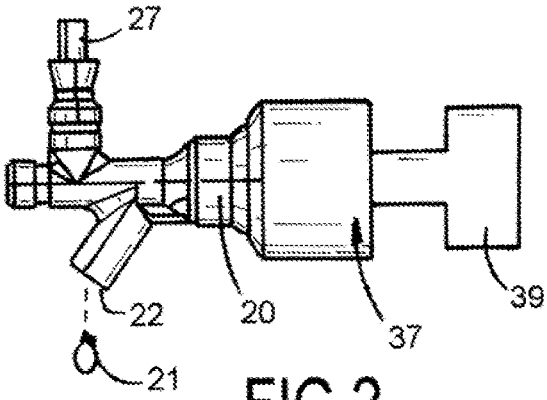
FIG. 2, illustrates a side view of an inventive tap spigot apparatus that provides a connection between the inventive fluid measuring apparatus of FIG. 1, and a fluid dispenser.

FIG. 2, illustrates a side view of an inventive tap spigot system or apparatus 20, that provides a connection between the inventive fluid measuring apparatus 23, of FIG. 1, and a fluid dispenser 39. The inventive tap spigot apparatus 20, further comprises of a male or female connection 27, which is used to mate the inventive tap spigot apparatus 20, to the male or female connection 17, of the inventive fluid measuring apparatus 23, of FIG. 1. The inventive tap spigot apparatus 20, further has at least one line connecting means 37, at one end, that is used to connect to a line or keg or fluid dispenser 39, and a second end having, at least one opening 22, or spigot opening 22, for the dispensing of at least one fluid 21, that is contained in the fluid dispenser 39. The male or female connection 17, of the tap threading adapter 16, also allows the inventive fluid measuring apparatus 23, to be attached to any preexisting tap line system 20, via the male or female connection 27. The fluid dispenser 39, could be a keg 39, or a beer keg 39, or a liquid holding container 39, or a beer dispensing container 39, to name a few. The fluid 21, could be beer 21, soda 21, water 21, or any other dispensable fluid 21, to name a few.

Figure 3:
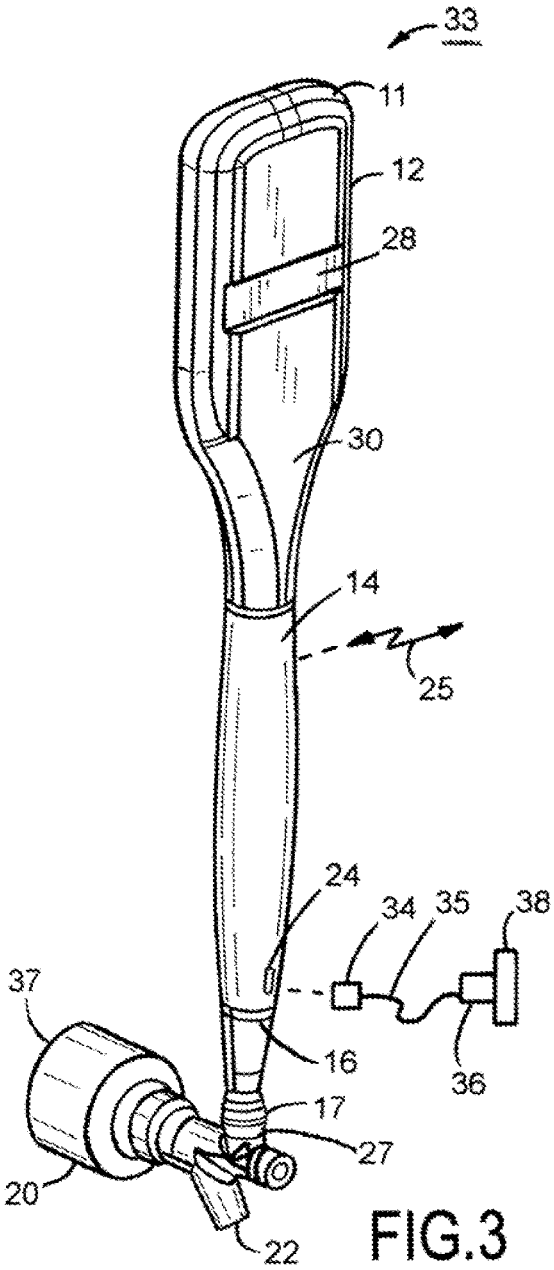
FIG. 3, illustrates a perspective view of an inventive fluid measuring apparatus, according to a second embodiment of this invention, which has been mated with an inventive tap spigot apparatus.
Figure 10:
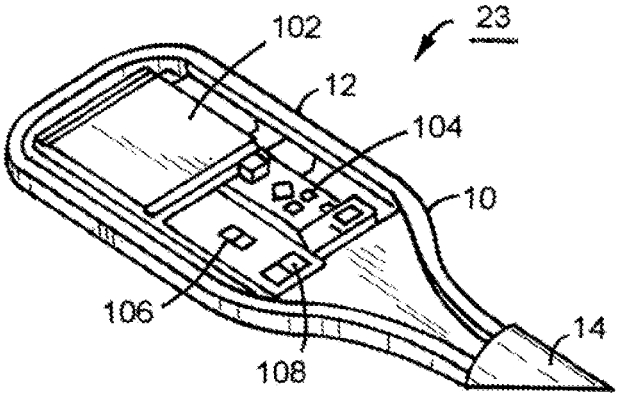
FIG. 10, illustrates a perspective view of an inventive fluid measuring apparatus with the cover removed.

FIG. 3, illustrates a perspective view of an inventive fluid measuring apparatus 33, according to a second embodiment of this invention, which has been mated with an inventive tap spigot apparatus 20. The inventive fluid measuring apparatus 33, could have a tap shell housing 30, having at least one readout screen 28, and at least one electrical/data port 24, such as, a USB port 24, a charging port 24, an inlet port 24, an outlet port 24, to name a few. It should be appreciated that the use of 'USB' 24, can be changed to a charge port 24, a data port 24, a power source port 24, to name a few. For some applications an electrical wire 35, having a first connection 34, and a second connection 36, could be used to electrically connect the tap shell housing or tap handle 30, to an electrical source or another device 38, such that, the first connection 34, would be electrically connected to the port 24, while the second connection 36, would be electrically connected to the electrical source or another device 38. For some applications the tap shell housing 30, components or display device(s), may be linked to a closed network, such as, for example, a Wi-Fi 25, a Bluetooth 25, a wireless connectivity, through a device 38, such as, a computer 38, a tablet 38, a smartphone 38, or a similar such device 38, which allows the use or operator to change and/or edit pictures or texts digitally for the fluid measuring apparatus 33, to display, whether it is on screen 18, or screen 28, or a screen associated with the device 38. For some applications the tap handle 30, could be battery powered 102, as shown in FIG. 10, and could be charged, such as, via a charge or data port 34, such as, a USB plug 34, at the bottom of the tap handle 30, or a micro USB port 24, on the tap handle 30. The data/charge port and/or USB capability also allows the inventive fluid measuring apparatus 33, to be updated via a hard line 35, if anything were to happen to the wireless connectivity 25, WI-FI connectivity 25, and/or Bluetooth connectivity 25. For some applications the tap handle 30, could be controlled via a wireless connectivity 25, or a hard line wire 35, using a secondary electronic device 38. It should be appreciated that a computer software 38, an application 38, and/or a website 38, could be used to pair with the inventive fluid measuring apparatus 33, so as to create and/or edit and/or customize a producer-made label and/or logos that would be displayed, such as, on screen 18, 28. For some applications the tap shell housing 30, could have read-out screen 28, on one side of the tap head or frame 12, and a second or separate display screen 18, on the other or opposite side of the tap shell housing 30. The port 24, also allows for the charging of an onboard battery 102, if the battery 102, is rechargeable, along with data transfer, firmware updates, to name a few.

Figure 4:
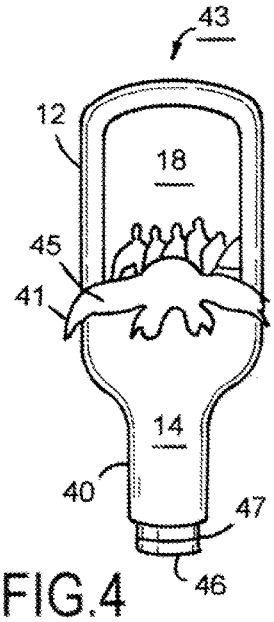
FIG. 4, illustrates a from view of an inventive fluid measuring apparatus, according to a third embodiment of this invention.

FIG. 4, illustrates a front view of an inventive fluid measuring apparatus 43, according to a third embodiment of this invention. The inventive fluid measuring apparatus 43, comprises of tap shell housing 40, having a tap adaptor 46, having a threaded and/or mate-able tap connection 47. For some applications the inventive fluid measuring apparatus 43, could have at least one decorative element 45, where the at least one decorative element 45, could be selected from a group comprising a ribbon-type image 45, a hops image 45, a wheat image 45, a barley image 45, a feather-type image 45, and combinations thereof, to name a few. Additionally, for some applications the inventive fluid measuring apparatus 43, could have at least one location to display at least one image 41, such as, a corporate logo 41, a branding logo 41, and combinations thereof, to name a few. The inventive fluid measuring apparatus 43, has the ability to display, such as, a beer logo 41, a beverage name 41, a photo 41, a GIF 41, a video 41, to name a few.

Figure 5:
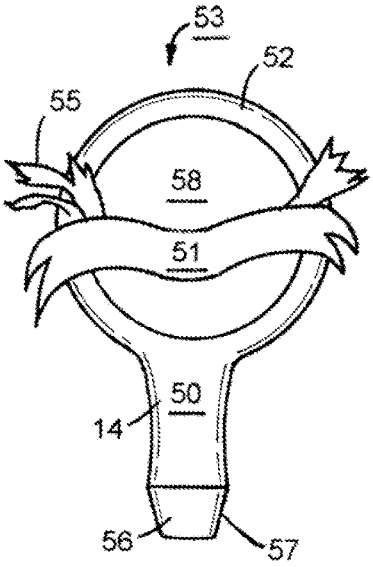
FIG. 5, illustrates a front view of an inventive fluid measuring apparatus, according to a fourth embodiment of this invention.

FIG. 5, illustrates a front view of an inventive fluid measuring apparatus 53, according to a fourth embodiment of this invention. The inventive fluid measuring apparatus 53, comprises of tap shell housing 50, having a tap adaptor 56, having a conical type tap connection 57, and a fancy or decorative tap head or frame 52, with a fancy or decorative display screen 58. For some applications the inventive fluid measuring apparatus 53, could have at least one decorative element 55, where the at least one decorative element 55, could be selected from a group comprising a ribbon-type image 55, a hops image 55, a wheat image 55, a barley image 55, a feather-type image 55, and combinations thereof, to name a few. Additionally, for some applications the inventive fluid measuring apparatus 53, could have at least one location to display at least one image 51, such as, a corporate logo 51, a branding logo 51, and combinations thereof, to name a few.

Figure 6:
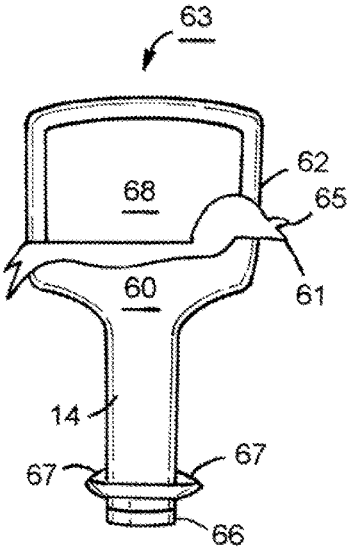
FIG. 6, illustrates a front view of an inventive fluid measuring apparatus, according to a fifth embodiment of this invention.

FIG. 6, illustrates a front view of an inventive fluid measuring apparatus 63, according to a fifth embodiment of this invention. The inventive fluid measuring apparatus 63, comprises of tap shell housing 60, having a tap adaptor 66, having at least one tap stopper 67, and/or at least one bayonet type connection 67, and a fancy or decorative tap head or frame 62, with a fancy or decorative display screen 68. For some applications the inventive fluid measuring apparatus 63, could have at least one decorative element 65, where the at least one decorative element 65, could be selected from a group comprising a ribbon-type image 65, a hops image 65, a wheat image 65, a barley image 65, a feather-type image 65, and combinations thereof, to name a few. Additionally, for some applications the inventive fluid measuring apparatus 63, could have at least one location to display at least one image 61, such as, a corporate logo 61, a branding logo 61, and combinations thereof, to name a few.

Figure 7:
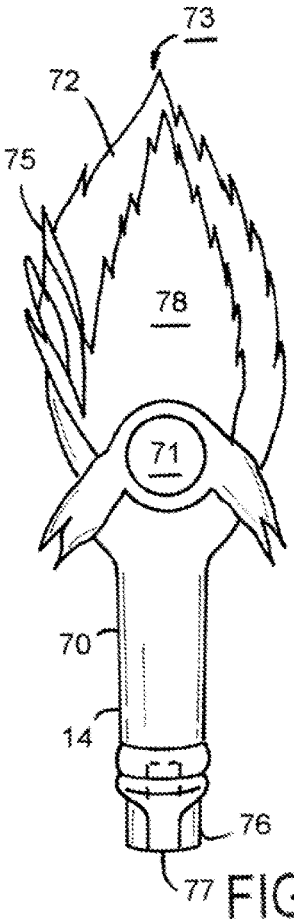
FIG. 7, illustrates a from view of an inventive fluid measuring apparatus, according to a sixth embodiment of this invention.

FIG. 7, illustrates a front view of an inventive fluid measuring apparatus 73, according to a sixth embodiment of this invention. The inventive fluid measuring apparatus 73, comprises of tap shell housing 70, having a tap adaptor 76, having a female tap connection 77, and a fancy or decorative tap head or frame 72, with a fancy or decorative display screen 78. For some applications the inventive fluid measuring apparatus 73, could have at least one decorative element 75, where the at least one decorative element 75, could be selected from a group comprising a ribbon-type image 75, a hops image 75, a wheat image 75, a barley image 75, a feather-type image 75, and combinations thereof, to name a few. Additionally, for some applications the inventive fluid measuring apparatus 73, could have at least one location to display at least one image 71, such as, a corporate logo 71, a branding logo 71, and combinations thereof, to name a few.

Figure 8:
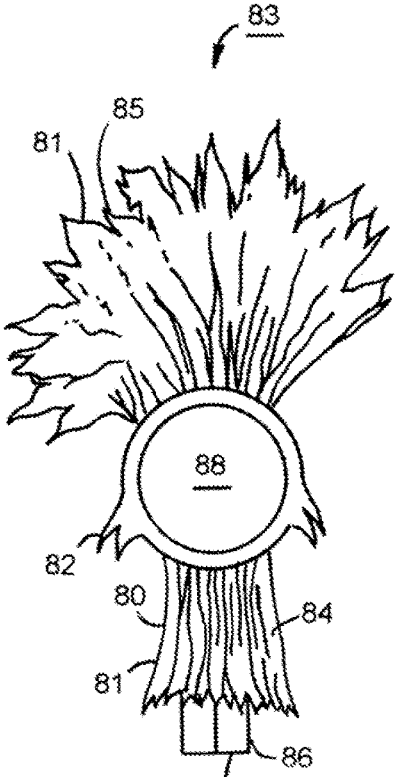
FIG. 8, illustrates a front view of an inventive fluid measuring apparatus, according to a seventh embodiment of this invention.

FIG. 8, illustrates a front view of an inventive fluid measuring apparatus 83, according to a seventh embodiment of this invention. The inventive fluid measuring apparatus 83, comprises of tap shell housing 80, having a tap adaptor 86, having a male tap connection 87, and a fancy or decorative tap head or frame 82, with a fancy or decorative display screen 88. For some applications the inventive fluid measuring apparatus 83, could have at least one decorative element 85, where the at least one decorative element 85, could be selected from a group comprising a ribbon-type image 85, a hops image 85, a wheat image 85, a barley image 85, a feather-type image 85, and combinations thereof, to name a few. Additionally, for some applications the inventive fluid measuring apparatus 83, could have at least one location to display at least one image 81, such as, a corporate logo 81, a branding logo 81, and combinations thereof, to name a few. For some applications the tap stem or handle 14, could be a decorative tap stem or handle 84. The decorative tap stem or handle 84, could also have at least one location to display at least one image 81, such as, a corporate logo 81, a branding logo 81, and combinations thereof, to name a few.

Figure 9:
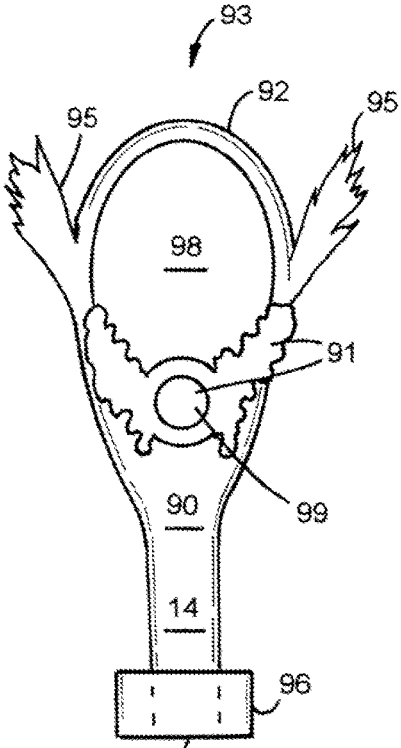
FIG. 9, illustrates a front view of an inventive fluid measuring apparatus, according to an eighth embodiment of this invention.

FIG. 9, illustrates a front view of an inventive fluid measuring apparatus 93, according to an eighth embodiment of this invention. The inventive fluid measuring apparatus 93, comprises of tap shell housing 90, having a tap adaptor 96, having a female tap connection 97, and a fancy or decorative tap head or frame 92, with a fancy or decorative display screen 98. For some applications the inventive fluid measuring apparatus 93, could have at least one decorative element 95, where the at least one decorative element 95, could be selected from a group comprising a ribbon-type image 95, a hops image 95, a wheat image 95, a barley image 95, a feather-type image 95, and combinations thereof, to name a few. Additionally, for some applications the inventive fluid measuring apparatus 93, could have at least one location to display at least one image 91, such as, a corporate logo 91, a branding logo 91, and combinations thereof, to name a few. For some applications the inventive fluid measuring apparatus 93, could have at least one additional or second screen or display 99.

FIG. 10, illustrates a perspective view of an inventive fluid measuring apparatus 23, with the cover 11, removed. The inventive fluid measuring apparatus 23, preferably has at least one power source 102, such as, a battery 102, a microprocessor 108, and at least one movement sensor 104, such as, for example, an accelerometer 104. The at least one movement sensor 104, records and is activated when the tap shell housing 10, is moved from a first position 13, to a second position 15, as illustrated in FIG. 1. For some applications the inventive fluid measuring apparatus 23, could also have at least one wireless data transfer unit 106, to transfer data to a second device 36, such as, another electronic device 36. The at least one power source 102, could be at least one battery 102, or a rechargeable battery 102. The microprocessor 108, could utilize connectivity 25, such as, for example, wireless connectivity 25, Wi-Fi connectivity 25, Bluetooth connectivity 25, to name a few, to allow a user or operator (not shown) to control and manage the images displayed on the display screen 18, 28, via a computer 38, a tablet 38, a smartphone 38, wirelessly 25, or via a push port 24. The accelerometer chip 104, or movement sensor 104, could be fastened or secured to the control board of the tap shell housing 10, and with the integration of the accelerometer 104, the tap shell housing will effectively track beer pouring or dispensing statistics in real time. Other features that can be extracted could be, for example, beer volume of the tapped keg, PSI (pounds per square inch) of the tap line 37, to allow for the calculation as to how much beer is being poured every time the tap handle 10, is pulled, etc. This additional information will allow proprietors, consumers, etc., to know how much beer they have poured and how much is left in the keg 39, or in the dispensing unit 39, in real time. This information can also be provided directly to distributors and brewers to give them more in depth data of how quickly the beverage is sold and by who.

It should be appreciated that the movement sensor 104, that is associated with the tap shell housing or handle 10, is sensitive enough that when the tap handle 10, is moved, such as, for example, from a first position 13, to a second position 15, it records not only the movement but also the duration. Thus, this allows the processing unit 108, that is connected to the movement sensor 104, to know or calculate, for example, how much fluid 21, or beer 21, was dispensed from the container 39, when the handle 10, was moved to allow the fluid 21, to pour out of the spigot opening 22.

Figure 11:
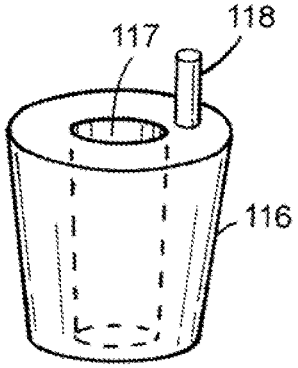
FIG. 11, illustrates a perspective view of an inventive tap adaptor apparatus that can be used with an inventive fluid measuring apparatus, according to this invention.

FIG. 11, illustrates a perspective view of an inventive tap adaptor apparatus 116, that can be used with an inventive fluid measuring apparatus 23, according to this invention. For some applications the inventive tap adaptor apparatus 116, could also be used as a tap extender 116, between the tap adaptor 16, and the tap spigot system 20. The tap adaptor 116, could also have at least one opening 117, to act as a female connection 117, and/or at least one male connection 118. For some applications the tap adaptor 116, could be the same as the tap adaptor 16, or the tap adaptor 116, could be used to replace the tap adaptor 16.

Figure 12:
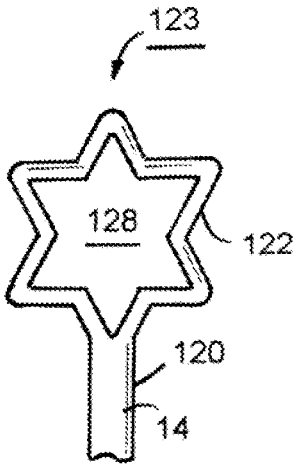
FIG. 12, illustrates a front view of an inventive fluid measuring apparatus, according to a ninth embodiment of this invention.

FIG. 12, illustrates a front view of an inventive fluid measuring apparatus 123, according to a ninth embodiment of this invention. The inventive fluid measuring apparatus 123, comprises of tap shell housing 120, having a fancy or decorative or stylistic or themed tap head or frame 122, with a fancy or decorative or stylistic or themed display screen 128.

Figure 13:
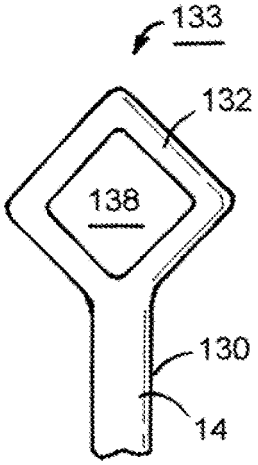
FIG. 13, illustrates a front view of an inventive fluid measuring apparatus, according to a tenth embodiment of this invention.

FIG. 13, illustrates a front view of an inventive fluid measuring apparatus 133, according to a tenth embodiment of this invention. The inventive fluid measuring apparatus 133, comprises of tap shell housing 130, having a fancy or decorative or stylistic or themed tap head or frame 132, with a fancy or decorative or stylistic or themed display screen 138.

Figure 14:
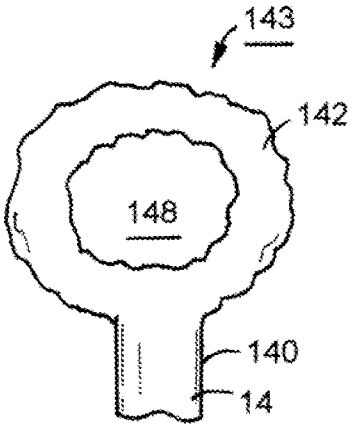
FIG. 14, illustrates a front view of an inventive fluid measuring apparatus, according to an eleventh embodiment of this invention.

FIG. 14, illustrates a front view of an inventive fluid measuring apparatus 143, according to an eleventh embodiment of this invention. The inventive fluid measuring apparatus 143, comprises of tap shell housing 140, having a fancy or decorative or stylistic or themed tap head or frame 142, with a fancy or decorative or stylistic or themed display screen 148.

Figure 15:
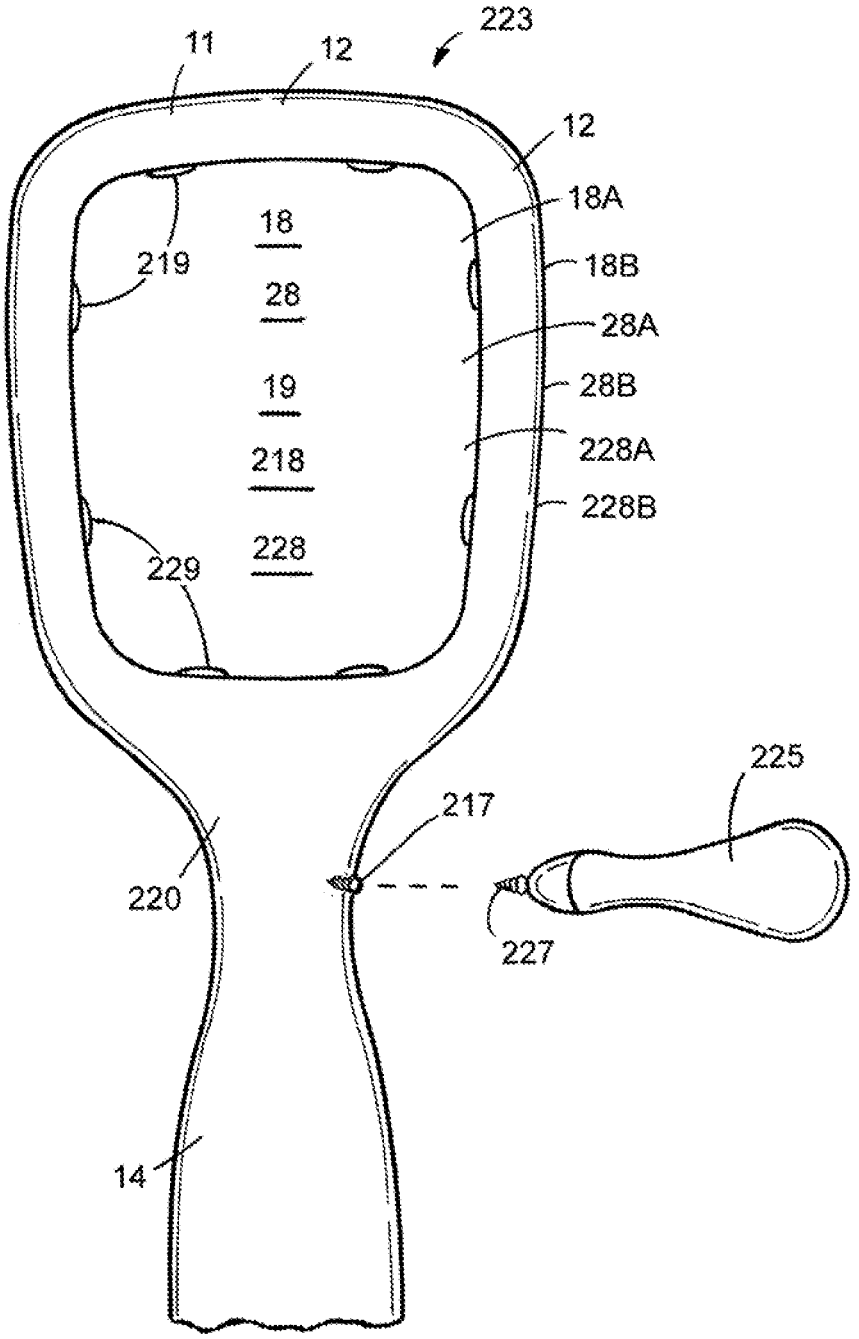
FIG. 15, illustrates a front view of an inventive fluid measuring apparatus, according to a twelfth embodiment of this invention.

FIG. 15, illustrates a front view of an inventive fluid measuring apparatus 223, according to a twelfth embodiment of this invention. The inventive fluid measuring apparatus or digital tap handle 223, comprises of tap shell housing 220, having at least one display screen 18, 28, 228, and at least one right-angle or secondary lever or handle 225, having a male or female portion 227. The tap shell housing 220, has at least one male or female portion 217, to securely accommodate the corresponding male or female portion 227, of the secondary handle 225, so that the secondary handle 225, can now be used to move the digital tap handle 10, from a first position 13, to a second position 15. The secondary tap handle 225, provides an ergonomic purpose, and ease of use of the main or primary digital tap handle 10. For the purposes of illustration the tap shell housing 220, could have an internal or recessed threading 217, comprising a female portion 217, while the secondary tap handle 225, could have threads 227, comprising a male portion 227, so that the secondary handle 225, could be screwed on to the primary or main handle 220, at, for example, a right angle. However, for some applications, the primary tap handle 220, could have a male potion 217, which would securely, mate with a female portion 227, of the secondary handle 225. For some applications the screen 228, could be made from a material that acts as a dry erase board 228, so that the user could write on the dry erase board 228, using for example, a dry erase marker (not shown). Additionally, for some applications one could have a screen 228, having at least one tab or tongue or sockets or grooves or slots 219, which could be used to securely mate or engage with a corresponding feature 229, on the tap head or frame 12. It should be appreciated that the digital tap handle 223, for some applications, could have a front screen or display 18A, 26A, 226A, and a back or rear screen or display 18B, 28B, 228B. The sockets or clips 229, around the screen 18, 28, allows for a plastic screen cover 228, to cover or protect the screen 18, 28. Additionally, for applications where the outward facing side of the screen cover 228, has been treated with a dry erase material, and which would allow for continued use of the tap 223, for example, in cases and situations where the batteries or wired options are not applicable or available.

Figure 16:
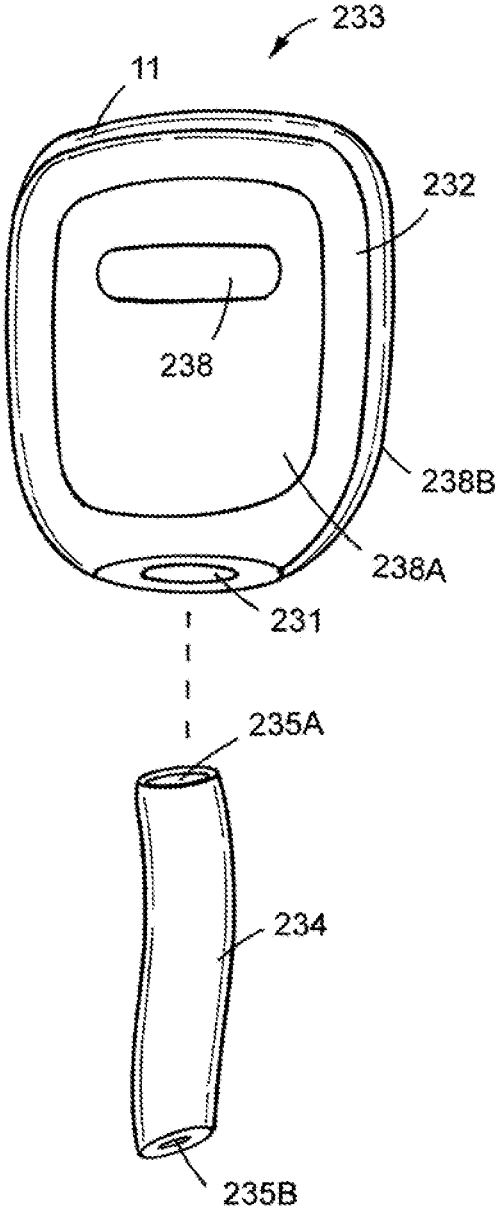
FIG. 16, illustrates a front view of an inventive fluid measuring apparatus, according to a thirteenth embodiment of this invention.

FIG. 16, illustrates a front view of an inventive fluid measuring apparatus 233, according to a thirteenth embodiment of this invention. The inventive fluid measuring apparatus or digital tap handle 233, comprises of tap shell housing sleeve 232, having at least one display screen or window 238, and a bottom opening or hole 231. The tap shell housing sleeve 232, would be slid onto the tap head or frame 12, using the hole or opening 231, such that the screen or window 238, are over the display or screen 18, or over the readout screen 28, so that the display or screen 18, or readout screen 28, is protected, while at the same time the digital readout is visible to a user via the at least one display window 238. The tap head cover or protector 232, could have a first or front display window 238A, to cover or protect a first or front display 18, or first or front readout 28, and a second or back display window 238B, to cover or protect a second or back display 18, or second or back readout 28. For some applications one could optionally also have a bottom sleeve or protector 234, having a through opening 235, having a first or upper end opening 235A, and a second or bottom end opening 235B, and then the bottom sleeve or protector 234, could be easily slid over the tap stem 14, either from the bottom or the top, as long as the bottom sleeve or protector 234, protects the stem 14. For some applications it is preferred that the top sleeve or cover 232, is made from a resistive or frictional material, such as, for example, a silicone material, a rubber material, a composite material, and combinations thereof, to name a few. For some applications it is preferred that the bottom sleeve or cover 234, is made from a resistive or frictional material, such as, for example, a silicone material, a rubber material, a composite material, and combinations thereof, to name a few. It should be appreciated that protective sleeve or cover 232, and/or 234, allows a user to easily grab and pull or rotate, for example, the tap 23, from a first position 13, to a second position 15.

Figure 17:
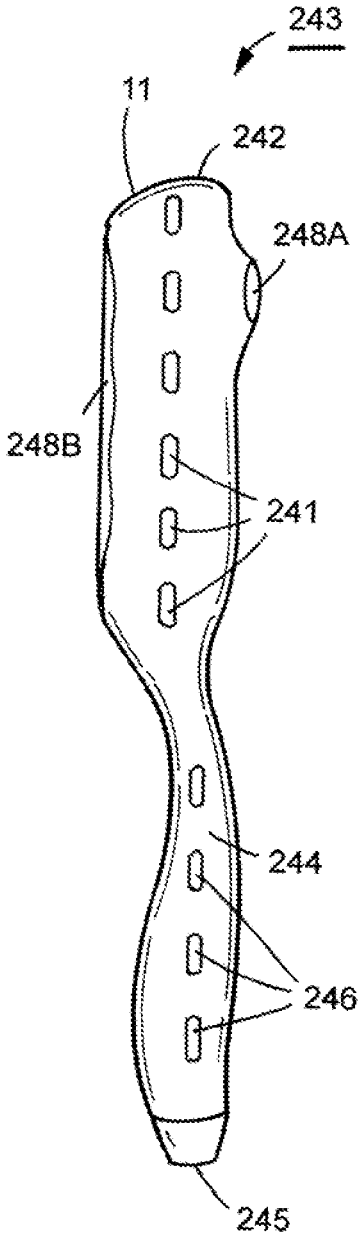
FIG. 17, illustrates a front view of an inventive fluid measuring apparatus, according to a fourteenth embodiment of this invention.

FIG. 17, illustrates a front view of an inventive fluid measuring apparatus 243, according to a fourteenth embodiment of this invention. The inventive fluid measuring apparatus or digital tap handle 243, comprises of tap shell housing sleeve or cover 242, having at least one display screen or window 248, a bottom sleeve portion 244, and having a bottom opening or hole 245. The tap shell housing sleeve 242, would be slid onto the tap head or frame 12, using the hole or opening 245, such that the screen or window 248, are over the display or screen 18, or over the readout screen 28, so that the display or screen 18, or readout screen 28, is protected, while at the same time the digital readout is visible to a user via the at least one display window 248, and that the tap stem 14, is covered or protected by the bottom sleeve portion 244. The tap head cover or protector 242, could have a first or front display window 248A, to cover or protect a first or front display 18, or first or front readout 28, and a second or back display window 248B, to cover or protect a second or back display 18, or second or back readout 28. For some applications it is preferred that the sleeve or cover 242, is made from a resistive or frictional material, such as, for example, a silicone material, a rubber material, a composite material, and combinations thereof, to name a few. It should be appreciated that protective sleeve or cover 242, allows a user to easily grab and pull or rotate, for example, the tap 23, from a first position 13, to a second position 15. For some applications the tap shell housing sleeve 242, could have a plurality of gripping means 241, or grooves 241, or tabs 241, or protrusions 241, or holes 241, to allow for the easy gripping of the tap head or frame 12. For some applications the bottom sleeve portion 244, could have a plurality of gripping means 246, or grooves 246, or tabs 246, or protrusions 246, or holes 246, to allow for the easy gripping of the tap stem 14. It is preferred that the grooves 241, 244, and up and down along the side of the tap handle 10, so that a silicone or rubber sleeve 242, can be put over the tap body 23, for better protection and for a better grip of the tap body 23. As shown in FIG. 17, the sleeve 242, comprises of a top portion or piece 242, and a bottom portion or piece 244, and both of these portions or pieces are connected to form a one piece protective cover 242.

Figure 18:
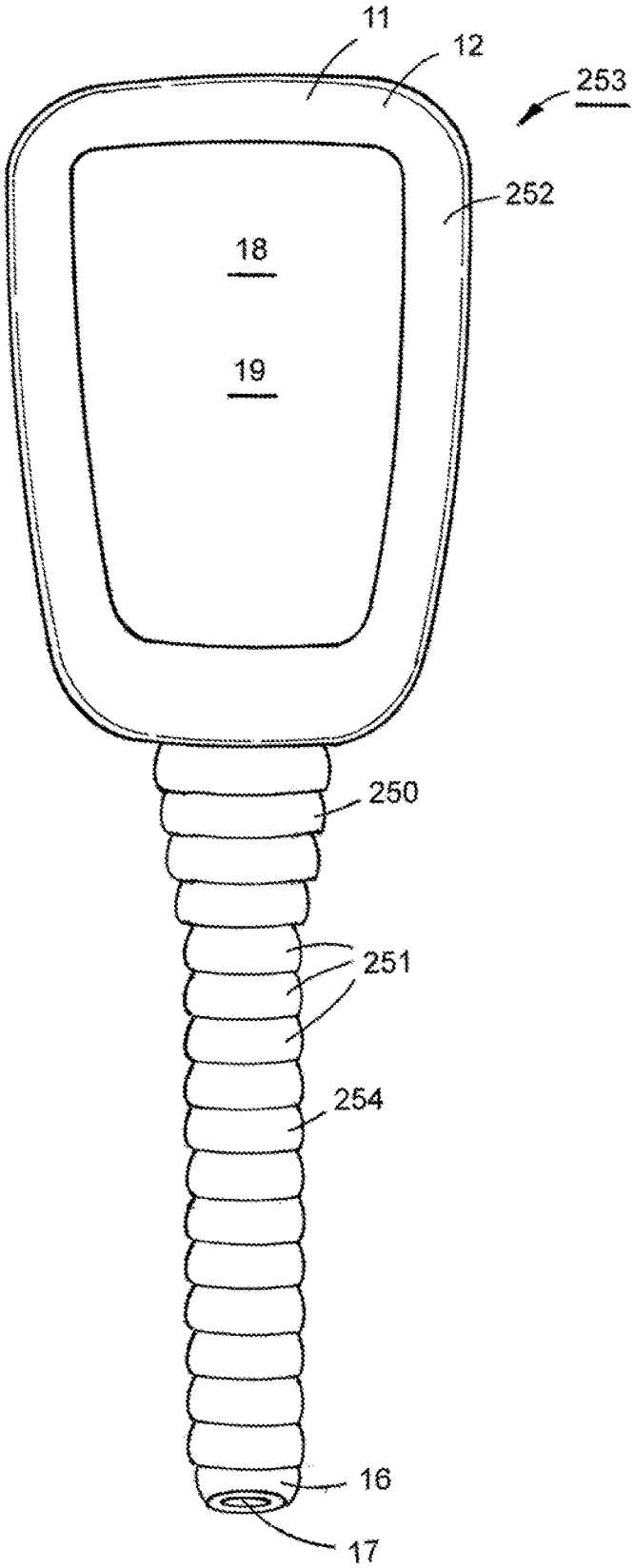
FIG. 18, illustrates a front view of an inventive fluid measuring apparatus, according to a fifteenth embodiment of this invention.

FIG. 18, illustrates a front view of an inventive fluid measuring apparatus 253, according to a fifteenth embodiment of this invention. The inventive fluid measuring apparatus or digital tap handle 253, comprises of telescopic tap shell housing or handle 250, having a plurality of telescoping elements or connections 251, and having at least one display screen or window 18, 19, a tap head or frame 252, a telescopic tap stem 254, having a tab adaptor 16, with a male or female connection 17, which could be mated with a corresponding male or female connection 27, on the tap spigot line or apparatus 20. The telescoping handle 250, allows for a simplified storage of the tap handle 250, and also allows a user to be able to see the screen 18, 28, from practically any angle, as the telescopic tap housing or handle can be rotated along the telescoping elements or connections 251.

Figure 19:
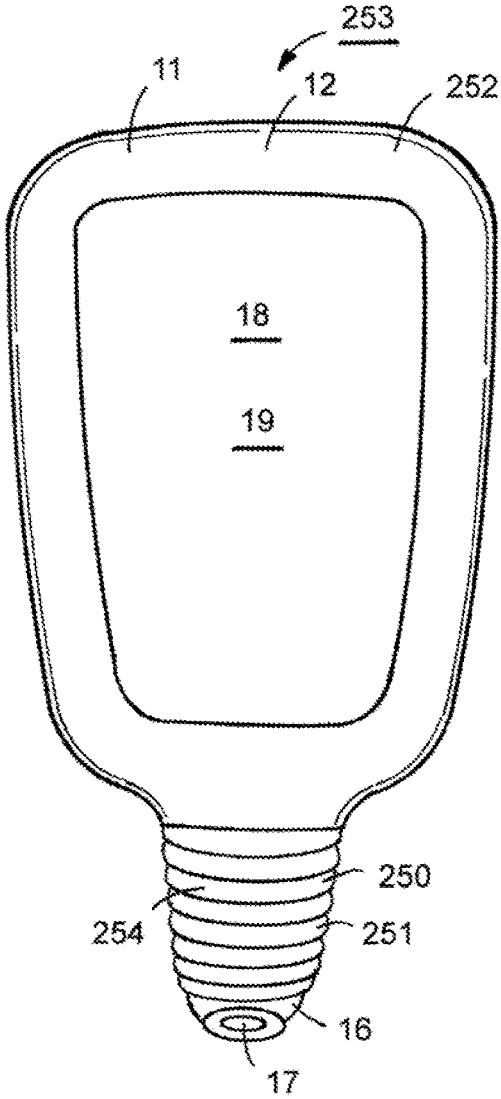
FIG. 19, illustrates a collapsed front view of an inventive fluid measuring apparatus, according to a fifteenth embodiment of this invention, as illustrated in FIG. 18.

FIG. 19, illustrates a collapsed front view of an inventive fluid measuring apparatus 253, according to a fifteenth embodiment of this invention, as illustrated in FIG. 18. As one can see that the telescoping elements 251, of the inventive fluid measuring apparatus or digital tap handle 253, have been collapsed and this allows a user to use the inventive digital tap handle 253, in a situation where space is a premium, or where the user wants to rotate the tap handle 253, to be able to easily see the display on the screen 18, 28, from most orientations.

The inventive static and dynamic display dispenser 23, 33, 43, 53, 63, 73, 83, 93, 123, 133, 143, for an in-line fluid flow, apparatus, system, and a method thereof, and more particularly directed to a digital tap stem or handle 10, 30, 40, 50, 60, 70, 80, 90, 120, 130, 140, for a beer dispensing apparatus 39, such as, a keg 39, a container 39, a pressurized container 39, to name a few.

In one aspect this invention is a tap stem or handle 10, 30, 40, 50, 60, 70, 80, 90, 120, 130, 140, that is integrated with at least one display or screen 18, 28, 48, 58, 68, 78, 88, 98, 128, 138, 148, and a microprocessor 108. One aspect of the inventive fluid measuring apparatus 23, 33, 43, 53, 63, 73, 83, 93, 123, 133, 143, is its ability to digitally display whatever the purveyor or supplier would like for the beverage name, logo, title, etc. they are offering.

For some applications the inventive fluid measuring apparatus 23, 33, 43, 53, 63, 73, 83, 93, 123, 133, 143, may have at least one read-out 28, on the back or opposite side to provide a user or an operator with data, such as, for example, beverage on tap 21, how much beer 21, in the keg 39, is left, how much battery life of the power source 102, is left, to name a few.

For some applications it is preferred that the working components, such as, the microprocessor 108, display 18, 28, 48, 58, 68, 78, 88, 98, 128, 138, 148, battery 102, chipset 106, accelerometer 104, may be encased in any type of waterproof or water resistant material 19, so as to prevent the working components to prematurely fail due to fluid contamination.

For some applications the software can be used to post in-depth information, such as, for example, flavor, ABV (alcohol by volume), hop level, IBU (International Bitterness Unit), SRM (Standard Reference Method), brewer information, in-house and/or national ratings, to name a few, such as, to a website, which will be accessible to patrons or requesters via an app or website 38. One could also have a website 38, that could be accessible to a patron via, for example, a scan-able QR (Quick Response) code, and that could, for example, display any promotions by the beverage company, or by the proprietor of facilities, or what is currently being offered at the facilities.

As stated earlier the use of a digital tap handle 23, or the fluid measuring apparatus 23, allows a purveyor or a supplier with the ability to engage their patrons with vibrant logos 91, 95, 99, and/or in-depth information about whatever beverage they choose. This information would allow a new element in the decision making process of a consumer by providing additional information that a traditional tap handle cannot provide. While the inventive tap stem or handle 10, is designed to display beer logos 45, 55, 65, 75, 85, 95, 125, 135, 145, or beverage name 45, 55, 65, 75, 85, 95, 125, 135, 145, it can also be used to display any potential advertising 41, 51, 61, 71, 81, 91, marketing 41, 51, 61, 71, 81, 91, or media 41, 51, 61, 71, 81, 91, the owner or operator of the tap handle 10, 30, 40, 50, 60, 70, 80, 90, 120, 130, 140, wishes to display. This invention also allows the purveyor the ability to properly advertise a rotating selection of beverages, as changes to the display will be possible at any time.

It should be appreciated that the tap read-out on the display screen 18, 28, 48, 58, 68, 78, 88, 98, 128, 138, 148, could be used for a variety of purposes, however, for some applications one could also have a digital read-out 18, 28, 48, 58, 68, 78, 88, 98, 128, 138, 148, on both sides of the tap shell housing 10, 30, 40, 50, 60, 70, 80, 90, 120, 130, 140.

The cross-sectional shape for the inventive tap head or frame 12, 52, 62, 72, 82, 92, 122, 132, 142, can be selected from a group comprising a triangular shape, a square shape, a rectangular shape, a circular shape, an oval shape, a polygonal shape, a cylindrical shape, a themed shape, a stylistic shape, a decorative shape, an abstract shape, and combinations thereof, to name a few.

The cross-sectional shape for the at least one inventive display or screen 18, 28, 58, 68, 78, 88, 98, 128, 138, 148, can be selected from a group comprising a triangular shape, a square shape, a rectangular shape, a circular shape, an oval shape, a polygonal shape, a cylindrical shape, a themed shape, a stylistic shape, a decorative shape, an abstract shape, and combinations thereof, to name a few.

The integration of the inventive fluid measuring apparatus 23, also provides the proprietor with the ability to immerse their patrons or customers with, for example, vibrant logos 91, 95, 99, and in depth information about whatever beer they are drinking. It should be appreciated that while the tap shell housing is designed to display beer logos 41, 51, 61, 71, 81, 91, it can also be used to display any potential advertising, marketing or media that the owner or proprietor of the tap wishes to display 41, 51, 61, 71, 81, 91.

The in-line fluid flow measuring apparatus 23, having the tap shell housing 10, has at least one electronic port 24, and wherein the at least one electronic port 24, is selected from a group comprising an electrical port 24, a USB port 24, a mini USB port 24, a micro USB port 24, a charging port 24, a data port 24, a power source port 24, and combinations thereof, to name a few.

The in-line fluid flow measuring apparatus 23, having the tap shell housing 10, has at least one location to display at least one image 41, 45, 51, 55, 61, 65, 71, 75, 81, 84, 85, 91, 95, 99, and wherein the at least one image 41, 45, 51, 55, 61, 65, 71, 75, 81, 84, 85, 91, 95, 99, is selected from a group comprising of a corporate logo, a branding logo, a beer logo, a beverage name, a photograph, a GIF (Graphics Interchange Format) image, a video, and combinations thereof, to name a few.

The tool used in the preset invention, namely, the inventive fluid measuring apparatus 23, 33, 43, 53, 63, 73, 83, 93, 123, 133, 143, may be implemented using one or more computers 38, executing software instructions. According to one embodiment of the present invention, the inventive fluid measuring apparatus 23, 33, 43, 53, 63, 73, 83, 93, 123, 133, 143, may communicate with server and client computer systems 38, that transmit and receive data over a computer network 35, or a fiber or copper-based telecommunications network 35, or other forms of data transfer networks 35, or wireless network 25. The steps of accessing, downloading, and manipulating the data, as well as other aspects of the present invention are implemented by central processing units (CPU) in the server and client computers executing sequences of instructions stored in a memory. The memory may be a random access memory (RAM), read-only memory (ROM), a persistent store, such as a mass storage device, or any combination of these devices. Execution of the sequences of instructions causes the CPU to perform steps according to embodiments of the present invention.

The instructions may be loaded into the memory of the server or client computers 38, from a storage device 38, or from one or more other computer systems 38, over a network connection 25, 35. For example, a client computer may transmit a sequence of instructions to the server computer in response to a message transmitted to the client over a network by the server. As the server receives the instructions over the network connection, it stores the instructions in memory. The server may store the instructions for later execution, or it may execute the instructions as they arrive over the network connection. In some cases, the CPU may directly support the downloaded instructions, in other cases, the instructions may not be directly executable by the CPU, and may instead be executed by an interpreter that interprets the instructions. In other embodiments, hardwired circuitry may be used in place of, or in combination with, software instructions to implement the present invention. Thus tools used in the present invention am not limited to any specific combination of hardware circuitry and software, nor to any particular source for the instructions executed by the server or client computers. In some instances, the client and server functionality may be implemented on a single computer platform.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel apparatus, methods, and systems, described herein may be embodied in a variety of other forms; furthermore, various omissions, substitutions and changes in the form of the methods and systems described herein may be made without departing from the spirit of the inventions.

It should be further understood that throughout the specification and claims several terms have been used and they take the meanings explicitly associated herein, unless the context clearly dictates otherwise. For example, the phrase "in one embodiment" as used herein does not necessarily refer to the same embodiment, though it may. Additionally, the phrase "in another embodiment" as used herein does not necessarily refer to a different embodiment, although it may. Thus, various embodiments of the invention may be readily combined, without departing from the scope or spirit of the invention.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An in-line fluid flow measuring and dispensing apparatus, consisting of:

(a) a tap shell housing having a tap stem at one end, and a tap head at an opposite end, and wherein said tap shell housing has at least one electronic switch;

(b) said tap head having at least one first digital display screen on one side of said tap head, and at least one second digital display screen on the opposite side of said tap head;

(c) said tap stem having a tap stem protector and a tap adaptor, wherein said tap adaptor securely engages with a tap spigot system;

(d) said spigot system having at least one line connection with at least one fluid dispenser at one end, and at least one opening at an opposite end for dispensing of said at least one fluid; and (e) wherein a tap head protector having at least one fluid proof window is slideabiy slid over said tap head, and wherein said tap head protector protects one of said at least one first digital display screen, and said at least one second digital display screen, and said at least one fluid proof window allows an unobstructed viewing of one of said at least one first digital display screen, and said at least one second digital display screen.

2. The in-line fluid flow measuring and dispensing apparatus of claim 1, wherein said tap shell housing is capable of being moved from a first position to a second position.

3. The in-line fluid flow measuring and dispensing apparatus of claim 1, wherein said tap shell housing is capable of being moved from a first position to a second position, and wherein said movement from said first position to said second position allows for said dispensing of said at least one fluid via said at least one opening in said spigot system.

4. The in-line fluid flow measuring and dispensing apparatus of claim 1, wherein said tap shell housing is capable of being moved from a first position to a second position, and wherein said movement from said first position to said second position is selected from a group consisting of a rotational movement, a translational movement, a sliding movement, and combinations thereof.

5. The in-line fluid flow measuring and dispensing apparatus of claim 1, wherein said at least one fluid is selected from a group consisting of beer, beverage, water, carbonated beverage, dispensable fluid, and combinations thereof.

6. The in-line fluid flow measuring and dispensing apparatus of claim 1, wherein said tap shell housing has at least one electronic port.

7. The in-line fluid flow measuring and dispensing apparatus of claim 1, wherein said tap shell housing has at least one electronic port, and wherein said at least one electronic port is selected from a group consisting of an electrical port, a USB port, a mini USB port, a micro USB port, a charging port, a data port, a power source port, and combinations thereof.

8. The in-line fluid flow measuring and dispensing apparatus of claim 1, wherein said tap head protector sleeve is in physical contact with said tap stem protector.

9. The in-line fluid flow measuring and dispensing apparatus of claim 1, wherein said tap head is selected from a group consisting of a triangular shape, a square shape, a rectangular shape, a circular shape, an oval shape, a, polygonal shape, a cylindrical shape, a themed shape, a stylistic shape, a decorative shape, an abstract shape, and combinations thereof.

10. The in-line fluid flow measuring and dispensing apparatus of claim 1, wherein said tap head protector has gripping means running along the sides of said tap head protector between said at least one first digital display screen, and said at least one second digital display screen.

11. The in-line fluid flow measuring and dispensing apparatus of claim 1, wherein said tap head protector is connected to said tap stem protector, and said tap head protector has gripping means running along the sides of said tap head protector and said tap stem protector between said at least one first digital display screen, and said at least one second digital display screen.

12. The in-line fluid flow measuring and dispensing apparatus of claim 1, wherein said tap shell housing has a secondary handle.

13. The in-line fluid flow measuring and dispensing apparatus of claim 1, wherein said tap shell housing has a secondary handle, and said secondary handle is in a plane parallel to a plane of said at least one first digital display screen, and said at least one second digital display screen.

14. The in-line fluid flow measuring and dispensing apparatus of claim 1, wherein said tap shell housing has at least one electrical device to measure a movement from a first position to a second position of said tap shell housing, and to calculate an amount of said dispensed fluid.

15. An in-line fluid flow measuring and dispensing apparatus, consisting of:

(a) a tap shell housing having a tap stem at one end, and a tap head at an opposite end, and wherein said tap shell housing has at least one electronic switch;

(h) said tap head having at least one first digital display screen on one side of said tap head, and at least one second digital display screen on the opposite side of said tap head;

(c) said tap stem having a tap adaptor, wherein said tap adaptor securely engages with a tap spigot system;

(d) said spigot system having at least one line connection with at least one fluid dispenser at one end, and at least one opening at an opposite end for dispensing of said at least one fluid;

(e) said tap head has a tap head protector, and said tap stem having a tap stem protector; and (f) wherein said tap shell housing is a telescopic housing, such that said tap head moves from a first place to a second place telescopically.

16. The in-line fluid flow measuring and dispensing apparatus of claim 15, wherein said tap head protector is connected to said tap stem protector.

17. The in-line fluid flow measuring and dispensing apparatus of claim 15, wherein said tap head protector has gripping means running along the sides of said tap head protector between said at least one first digital display screen, and said at least one second digital display screen.

18. The in-line fluid flow measuring and dispensing apparatus of claim 15, wherein said tap shell housing has at least one electronic port.

* * * * *